United States Patent [19]

Erdelitsch et al.

[11] Patent Number: 4,739,132

[45] Date of Patent: Apr. 19, 1988

[54] ELECTRIC STEERING COLUMN SWITCH FOR MOTOR VEHICLES

[75] Inventors: Herbert Erdelitsch; Walter Hecht; Horst Rachner, all of Bietigheim-Bissingen, Fed. Rep. of Germany

[73] Assignee: SWF Auto-Electric GmbH, Bietigheim-Bissingen, Fed. Rep. of Germany

[21] Appl. No.: 921,348

[22] Filed: Oct. 20, 1986

[51] Int. Cl.[4] ..... H01H 9/00

[52] U.S. Cl. ..... 200/61.54; 200/61.27

[58] Field of Search ..... 200/61.54, 61.27

[56] References Cited

U.S. PATENT DOCUMENTS 4,336,428 6/1982 Berginski ..... 200/61.54

*Primary Examiner*—A. D. Pellinen

*Assistant Examiner*—Morris Ginsburg

*Attorney, Agent, or Firm*—James B. Raden; Robert P. Seitter

[57] ABSTRACT

This invention relates to a steering column switch with two switch units arranged in superposed planes, which switch units each have a board with injection-moulded metal conductors and plug contacts the ends of which are rectangularly bent. The ends of the plug contacts of the switch unit which, in the plugging direction, is farther away from the connector, are positioned laterally of the ends of the other switch unit with a spacing from a conceived plane through the housing, which spacing is larger than the spacing of the ends of the plug contacts of the other switch unit from this plane. Thus a compact construction of the connection area of the switch is ensured.

15 Claims, 4 Drawing Sheets

ELECTRIC STEERING COLUMN SWITCH FOR MOTOR VEHICLES

BACKGROUND OF THE INVENTION

This invention relates to a steering column switch for use with motor vehicles.

A switch of this type is known from German Pat. No. 3,515,911. As far as this switch is concerned the problem of connecting the upper and lower switch units to the electric components in a simple and reliable way, by each of which switch units several electric performances can be switched and which accordingly have a plurality of plug contacts, has not yet been solved. The housing must not exceed particular outer dimensions. For this reason, the arrangement of the plug contacts is a problem. Moreover, the plug contacts of each switch unit must have their ends arranged in a particular way relative to one another in view of the precondition that they are embedded in a base plate using a simple holding tool. In addition, connectors of a complicated construction would then be necessary which could only be properly connected with the plug contacts with difficulty.

It is an object of the invention to create a switch of the type described which is constructed as simply and compactly as possible and which can be reliably connected with electric components without difficulty.

SUMMARY OF THE INVENTION

This problem is solved according to the present invention wherein a plurality of plug contact ends are concentrated in the same switch area, whereby a compact constructin of the switch connection area is ensured and the use of a compactly constructed connector is possible. Embodiments are provided in which as many plug contacts as possible or all of them end in the same switch area. Because the plug contact ends of the switch unit which in the plugging direction is farther away from the connector extend radially outwardly of the longitudinal plug contact ends of the other switch unit, the plug contact ends of both switch units do not have surfaces closely adjacent to each other. Thereby a high degree of electric security is ensured. Furthermore, the plug contact ends of the two switch units can therefore be arranged opposite each other, which is further contribution to a compact construction.

In other embodiments it is ensured that during the embedding process a simple holding tool can be used for the plug contacts. Moreover the use of a connector with an uncomplicated interior construction is made possible thereby. In another embodiment, the plug contact ends of the individual switch units can be arranged beside one another without the risk of touching and nevertheless in a compact way. By means of a frame, the plug contact ends of the switch unit which in the plugging direction are farther away from the connector can be protected against undesired contact. Moreover, by utilizing a frame of this kind, the two switch units can be aligned in proper position and that the connector can be mounted in proper position. It is pointed out that this measure is important because it can also be advantageously used in a switch in which the plug contacts are not embedded in the base plate material, but laid upon the base plate.

In other embodiments of the frame, the mounting of the connector in the proper position can be further assured. An unnecessarily large construction of the frame can be prevented, when it is arranged on the switch. Also, the frame can be connected with the switch in an uncomplicated manner.

In still another embodiment of the present invention, an unintended bending of the plug contact ends can also be prevented. This development enables in addition an alignment of the two switch units in proper position without additional auxiliaries. Thereby it is possible without difficulty to separate the switch units, for example in order to carry out repairs, by pulling the boards apart. It is pointed out that this measure is particularly important because it can also be applied in a switch in which the plug contacts are not embedded in base plate material, but laid upon the base plate.

A large, throughgoing stop face for the connector is created by a further development whereby the security of the connection is increased. Moreover, a simple interior construction of this connector is made possible as well as by the measure.

BRIEF DESCRIPTION OF THE DRAWING

The invention is described below by way of an embodiment shown in the accompanying drawing, in which.

DETAILED DESCRIPTION

Figure 1:
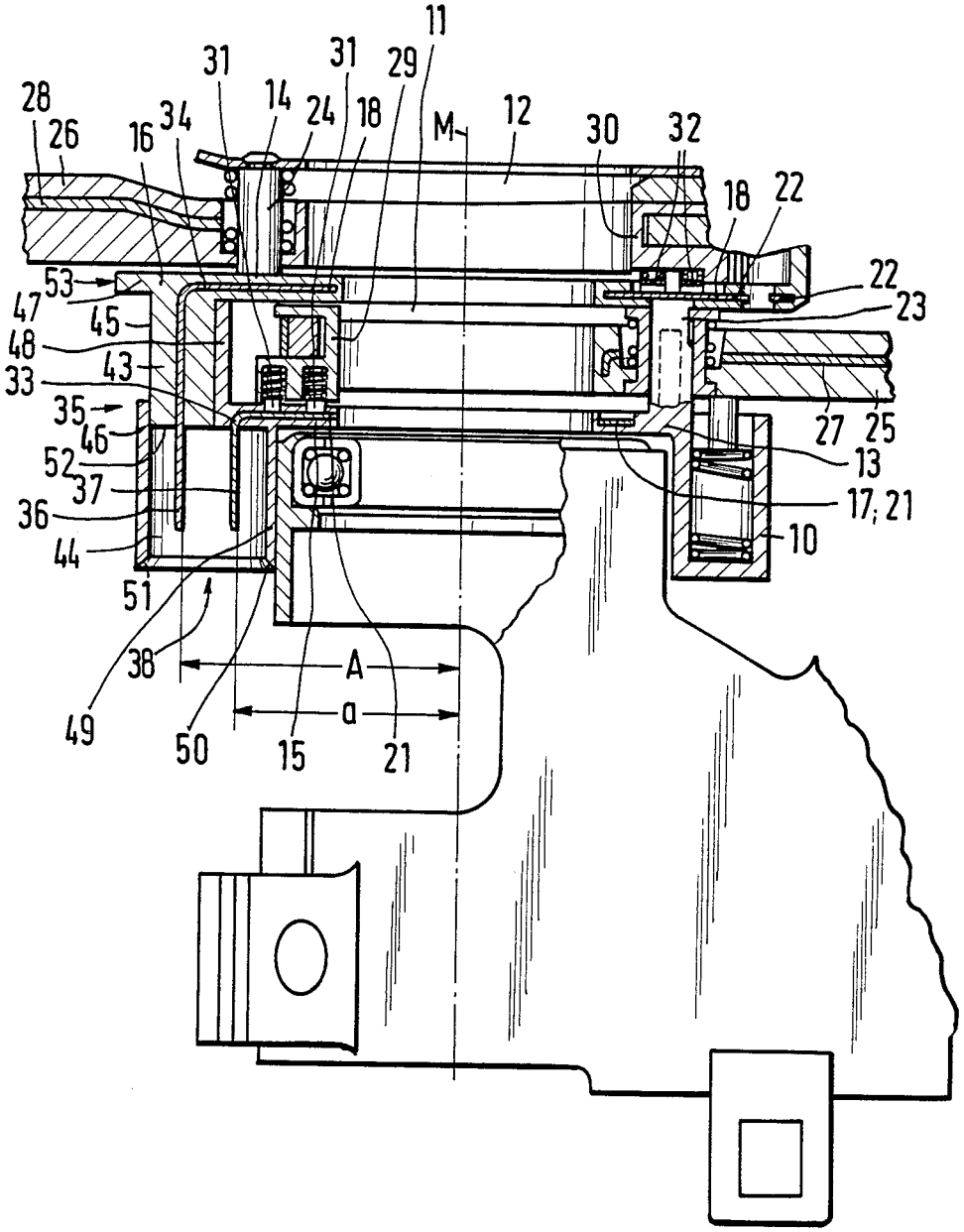
FIG. 1 is a longitudinal section through the switch taken on the line I—I of FIG. 2.
Figure 3:
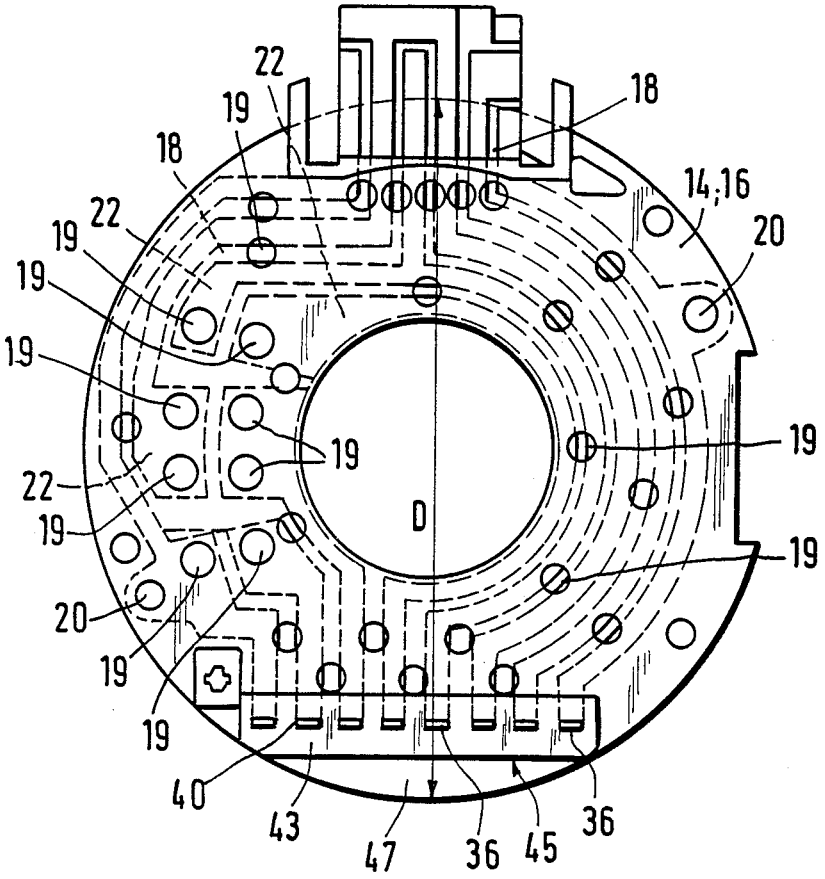
FIG. 3 shows the base plate of the switch unit which in the plugging direction is farther away from the connector.

The steering column switch completely shown in FIG. 1 has a housing 10 which is approximately shaped like a cylindrical tube with two switch units 11 and 12 arranged therein in two superposed planes. The lower switch unit 11 includes a circuit board 13 having base plate 15 and the upper switch unit 12 includes a circuit board 14 having a base plate 16 . The base plates 15 and 16 are constructed of plastic material. In the base plates 15 and 16 there are embedded a plurality of metal conductors 17 and 18 punched out from a sheet metal blank. In the base plates 15 and 16 there are recesses 19 or apertures 20 through which, during the injection-moulding process, pins of an injection moulding die project, by means of which the conductors are arranged in the proper position in the respective base plate. The recesses 19 and the apertures 20 are shown in FIG. 3. The metal conductors 17 have areas 21, which can be regarded as stationary contacts of the switch unit 11. The metal conductors 18 have areas 22,which are to be regarded as stationary contacts of the switch unit 12. As FIG. 1 shows, the base plate 15 has a pin 23 on which a switch lever 25 is rotatably supported and base plate 16 has a pin 24 on which a switch lever 26 is rotatably supported. The switch levers 25 and 26 are made of plastic material, but re-enforced by a metal insert in order to increase the stability. Switching members 29 and 30 are integrally formed on switch levers 25 and 26, respectively, by which switching members several switch contacts 31, 32 can be moved. The switch lever 25 is the wiper-washer-switch lever, while the switch lever 26 is the turn-signal and headlight switch lever.

FIGS. 1 and 3 show the stationary contacts 22 of the switch unit 12 which are arranged on the base plate 16 of the board 14. However, as FIGS. 1 and 2 both show, the portions of the metal conductors 17 to be regarded as plug contacts 33 of the board 13 and the portions of the metal conductors 18 to be regarded as plug contacts 34 of the board 14, are arranged in the same switch area 35. The plug contacts 33 and 34 have ends 36 and 37, respectively, which are bent perpendicularly away from the respective base plates 15 and 16 and point in the downward direction. At these ends 36 and 37 the switch units 11 and 12 can be connected with an electric network of a motor vehicle by leading a connector (not shown) in the plugging direction 38.

FIG. 1 shows the ends 36 of the plug contacts 34 of the upper switch unit 12, which extend laterally of the ends 37 of the plug contacts 33 of the lower switch unit 11 with a spacing A radially from the mid-perpendicular M on the mid-plane E of the housing 10. This spacing A is larger than the spacing a of the ends 37 of the plug contacts 33 of the lower switch unit 11 radially from the mid-perpendicular M. Thereby it is possible for the switch assembly to have two rows of plug contact ends extending from separate injection moulded boards 11 and 13 laterally adjacent each other. The switch, thereby, has a compactly constructed switch connection area 35, in which the use of a single, compactly constructed connector is possible. Because the ends 36 of the plug contact of the switch unit 12 which in the plugging direction 38, are located radially outwardly of the ends 37 of the plug contacts 33 of the lower switch unit 11, the ends 36 and 37 of the plug contacts 33 and 34, respectively of the two switch units 11 and 12 have no closely adjacent surfaces so that a high degree of electric security is ensured. As FIG. 2 further shows, the ends 36 and 37 of the plug contacts 33 and 34 of the switch units 11 and 12 are arranged opposite each other. Thereby, it is assured that the switch area 35 will be relatively narrow in the circumferential direction of the housing 10.

Figure 2:
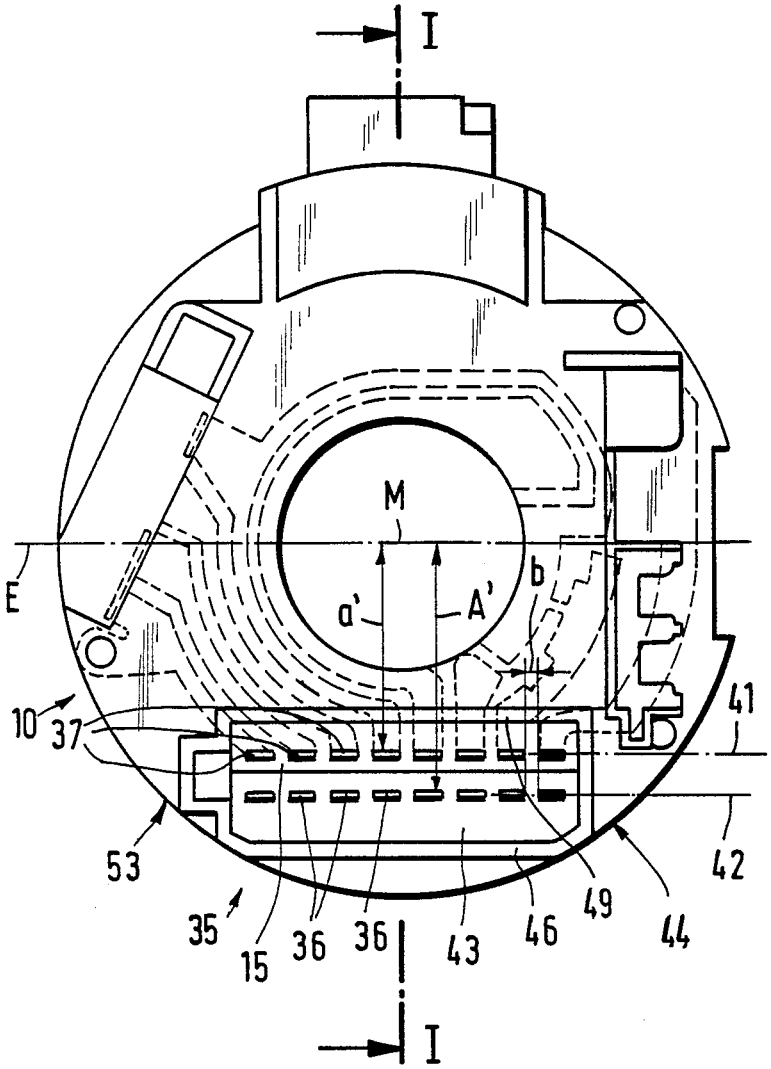
FIG. 2 shows the two units from below, however without switch lever.
Figure 4:
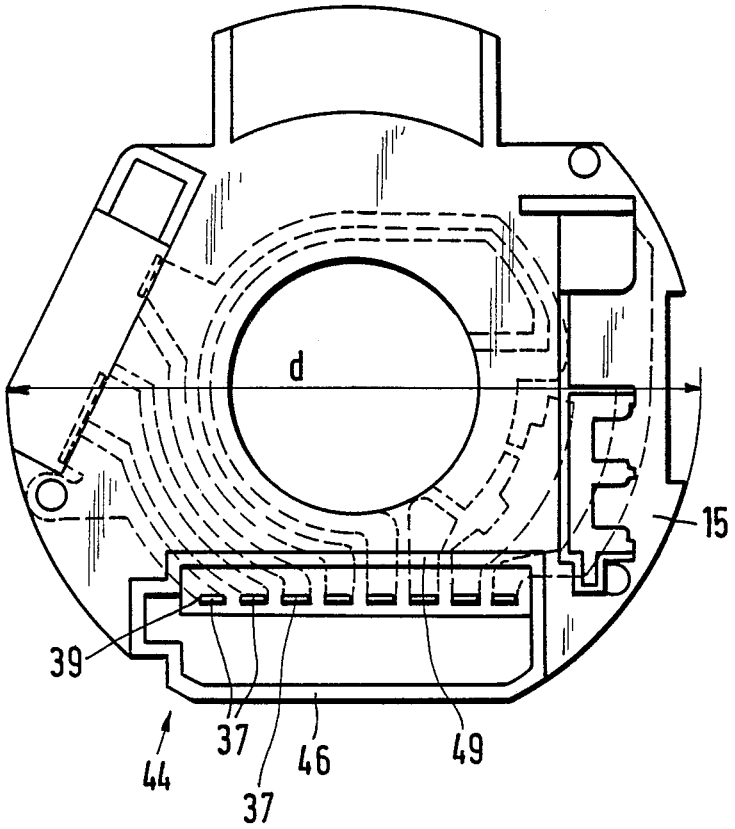
FIG. 4 illustrates the base plate of the switch unit which in the plugging direction is closer to the connector view from below.

FIGS. 2 to 4 show the ends 36 and 37 of the plug contacts 34 and 33 of the two switch units 12 and 11 which are each arranged in a straight line 42 and 41, respectively. The ends 36 of the switch unit 12 have a spacing A' from the longitudinal mid-plane E of the housing 10, which is larger than the spacing a' of the ends 37 of the switch unit 11 from the longitudinal mid-plane E as FIG. 2 shows. The ends 36 and 37 of the plug contacts 34 and 33 of the two switch units 12 and 11 have the same spacing b from each other at the longitudinal lateral surfaces 39 and 40, which spacing corresponds approximately to half of the width of the ends 36 and 37 transverse to the longitudinal direction. The ends 36 and 37 are thereby arranged beside one another without the risk of touching, but nevertheless in a compact way.

FIG. 1, furthermore, shows that the ends 36 of the plug contacts 34 of the switch unit 12, which in the plugging direction 38 are farther away from the connector, are substantially longer than the ends 37 of the other switch unit 11. In spite of this, they cannot be bent unintentionally when the connector is mounted, because they are embedded in a block 43 of base plate material over that part of their length which is not plugged into the connector, which block 43 projects perpendicularly from the base plate 16. The ends 37 of the other switch unit 11, also, cannot be unintentionally bent when the connector is mounted because they project into a frame 44 which is made in a single piece with the base plate 15 of the switch unit 11 and, as FIGS. 2 and 4 show, has a non-uniform decagonal shape.

FIGS. 1, 2 and 4 show the base plate 15 of the switch unit 11 which has a diameter d which is smaller than the diameter D of the base plate 16 of the switch unit 12 in the area of the outer surface 45 of the block 43. The frame 44 is thereby designed in such a way that it has an outside wall 46, which extends below the rim of the area 47 of the base plate 16, which is located laterally of the block 43. Thereby, the board 13 can be inserted in the frame 44 together with the block 43, whereby the block 43 and the frame 44 rest closely against each other in the area of the outer wall 46. As FIG. 1 furthermore shows the frame 44 has a wall 48 which extends perpendicularly upwardly to engage the base plate 16. The block 43 abuts against the frame 44 over the entire height of the wall 48. As FIG. 2 shows, the block 43 also fittingly nests within the other lateral walls of the frame 44 which have not been designated in detail. Furthermore, the wall 49 of frame 44 is positioned intermediate the mid-plane E of the housing 10 and the plug contacts 33 and 34, and extends parallel to the mid-plane E in a direction downwardly from the base plate 15. The walls 46 and 49 of the frame 44 include at their lower ends, guide surfaces 50 and 51, respectively, for accomodating the connector. As shown in FIG. 1, the block 43, in which the plug contacts 34 of the board 14 are injection-moulded, ends in the same plane as the base plate 15 of the switch unit 11. Thereby, a large, planar stop face 52 is formed for the connector whereby a high degree of security of the connection is ensured. Furthermore, this enables a simple interior construction of the connector. Because the frame 44 has a non-uniform contour, as has been mentioned above and as can especially be seen from FIG. 4, it is preferred to use a connector which also has a non-uniform contour and is adapted to the inner contour of the frame. Thereby, it is ensuredthat the connector will be properly mounted.

FIGS. 1 and 2, furthermore, show the frame 44 extending completely within the outer contour of the housing 10. On the whole, a compactly constructed switch is thus created in which the outer dimensions prescribed by the motor vehicle manufacturers are not exceeded and the switch units 11 and 12 can be easily detached, for exmaple for repairs, by simply pulling apart the boards.

What is claimed is:

1. An electrical switch assembly for motor vehicles comprising a housing having at least a first and second switch unit positioned therein, said first and second switch units being arranged in at least partially superposed planes, said first switch unit including a first circuit board member having a first planar base plate member with first plug contacts formed thereon, said second switch unit including a second circuit board member having a second planar base plate member with second plug contacts formed thereon, said first and second plug contacts having proximal and distal end sections, said proximal end sections of said first and second contacts being embedded within the plane of said first and second base plate members, respectivley, and said contacts being bent substantially perpendicular to the planes of said base plate members at a position intermediate said proximal and distal end sections so that said distal end sections ofsaid first contacts are aligned in a first row and said second contacts are aligned in a second row extending laterally of said first row with said first row of contacts being positioned radially outwardly of said second row of contacts.

2. The switch assembly of claim 1 wherein said first row of plug contacts is arranged parallel to said second row of plug contacts.

3. The switch assembly of claim 1 wherein at least one of said rows of contacts is aligned in a substantially straight line.

4. The switch assembly of claim 1 wherein the distal end sections of each of the plug contacts in at least one of said first and second rows are spaced substantially equidistant from each other longitudinally.

5. The switch assembly of claim 4 wherein the spacing between said distal end sections corresponds to half the width of said end sections transverse to their longitudinal axis.

6. The switch assembly of claim 1 wherein the distal end sections of said first contacts project into a frame which extends upwardly to abut said first base plate member and which extends downwardly below the distal end sections of said first and second plug contacts.

7. The switch assembly of claim 6 wherein said frame has at least one guide surface formed at its downward end for accomodating a connector.

8. The switch assembly of claim 7 wherein said frame has a non-uniform decagonal cross-sectional shape.

9. The switch assembly of claim 8 wherein said frame is fastened to the second base plate member of said second switch unit.

10. The switch assembly of claim 6 wherein said frame and said second base plate member are formed in one piece.

11. The switch assembly of claim 6 wherein the first plug contacts are partially embedded in a block of material, the contour of said block being at least partially adapted to abut with said frame.

12. The switch assembly of claim 11 wherein said block and said first base plate member are formed in one piece.

13. The switch assembly of claim 11 wherein said block terminates at a position substantially in the same plane as the second base plate member to form a planar stop face for accomodating a connector.

14. The switch assembly of claim 13 wherein said block and said frame are positioned within said housing.

15. The switch assembly of claim 1 wherein said distal end sections of said first and second plug contacts terminate substantially in the same lateral plane.

* * * * *